US008793059B2

(12) United States Patent
Albrecht et al.

(10) Patent No.: US 8,793,059 B2
(45) Date of Patent: Jul. 29, 2014

(54) METHOD FOR CONTROLLING A FUEL INJECTION SYSTEM OF AN INTERNAL COMBUSTION ENGINE

(75) Inventors: Oliver Albrecht, Bietigheim-Bissingen (DE); Frank Mueller, Weil Der Stadt (DE); Bernd Schroeder, Esslingen (DE); Jens Wolber, Gerlingen (DE); Markus Amler, Leonberg-Gebersheim (DE); Timm Hollmann, Benningen A.N. (DE); Christian Wiedmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 1049 days.

(21) Appl. No.: 12/739,150

(22) PCT Filed: Sep. 11, 2008

(86) PCT No.: PCT/EP2008/062084

§ 371 (c)(1),
(2), (4) Date: Jul. 27, 2010

(87) PCT Pub. No.: WO2009/053158

PCT Pub. Date: Apr. 30, 2009

(65) Prior Publication Data

US 2010/0282214 A1 Nov. 11, 2010

(30) Foreign Application Priority Data

Oct. 22, 2007 (DE) ..... 10 2007 050 297

(51) Int. Cl.

| | |
|---|---|
| ***B60T 7/12*** | (2006.01) |
| ***G05D 1/00*** | (2006.01) |
| ***G06F 7/00*** | (2006.01) |
| ***G06F 17/00*** | (2006.01) |
| ***F02D 41/38*** | (2006.01) |
| *F02M 59/36* | (2006.01) |

(52) U.S. Cl.

CPC .... *F02D 41/3854* (2013.01); *F02D 2200/0602* (2013.01); *F02D 2200/0614* (2013.01); *F02M 59/366* (2013.01); *F02D 2250/31* (2013.01); *F02D 2250/02* (2013.01)

USPC ..... 701/104; 123/447; 123/458; 123/506; 123/511; 123/516

(58) Field of Classification Search

USPC ..... 123/458, 464, 510, 511, 516, 506; 701/104, 113

See application file for complete search history.

(56) References Cited

U.S. PATENT DOCUMENTS

| | | | |
|---|---|---|---|
| 6,446,606 | B1 | 9/2002 | Krimmer et al. |
| 6,609,500 | B2 * | 8/2003 | Ricco et al. ..... 123/446 |

(Continued)

FOREIGN PATENT DOCUMENTS

| | | |
|---|---|---|
| DE | 198 53 103 | 5/2000 |
| DE | 199 51 410 | 5/2001 |

(Continued)

*Primary Examiner* — Hieu T Vo
*Assistant Examiner* — Sherman Manley
(74) *Attorney, Agent, or Firm* — Kenyon & Kenyon LLP

(57) ABSTRACT

In a method for controlling a fuel injection system (10) of an internal combustion engine, wherein the fuel injection system (10) comprises a manifold (24) and a high-pressure pump (20) and a fuel dosing unit (16) is associated with the high-pressure pump (20), wherein the fuel dosing unit (16) controls the amount of fuel delivered, an amount of fuel required for the operation of the internal combustion engine is determined as a function of a correction factor, which is based on a fuel pressure at the inlet of the high-pressure pump (20) and/or on a vapor pressure of the fuel to be delivered.

11 Claims, 2 Drawing Sheets

(56) References Cited

U.S. PATENT DOCUMENTS

| | | | | |
|---|---|---|---|---|
| 6,631,706 | B1 * | 10/2003 | Yamada et al. | 123/495 |
| 6,708,671 | B1 * | 3/2004 | Joos et al. | 123/464 |
| 7,350,510 | B2 * | 4/2008 | Tomatsuri et al. | 123/514 |
| 7,363,916 | B2 | 4/2008 | Eser et al. | |
| 7,438,051 | B2 * | 10/2008 | Wachtendorf et al. | 123/446 |
| 7,503,313 | B2 | 3/2009 | Achleitner et al. | |
| 7,568,468 | B2 | 8/2009 | Wolber et al. | |
| 2004/0074479 | A1 * | 4/2004 | Joos et al. | 123/497 |
| 2004/0112340 | A1 * | 6/2004 | Yomogida et al. | 123/497 |
| 2004/0216714 | A1 | 11/2004 | Tayama et al. | |
| 2005/0005912 | A1 * | 1/2005 | Joos et al. | 123/458 |
| 2007/0283929 | A1 * | 12/2007 | Funabashi et al. | 123/446 |
| 2009/0090331 | A1 * | 4/2009 | Pursifull | 123/446 |
| 2009/0211556 | A1 * | 8/2009 | Smith | 123/457 |
| 2009/0276141 | A1 * | 11/2009 | Surnilla et al. | 701/103 |
| 2010/0108029 | A1 * | 5/2010 | Rollinger et al. | 123/350 |
| 2010/0274467 | A1 * | 10/2010 | Hayami | 701/103 |
| 2011/0162622 | A1 * | 7/2011 | Kojima et al. | 123/457 |

FOREIGN PATENT DOCUMENTS

| | | |
|---|---|---|
| DE | 100 01 882 | 8/2001 |
| DE | 103 52 005 | 6/2005 |
| DE | 10 2004 062613 | 7/2006 |
| DE | 10 2005 025 114 | 12/2006 |
| EP | 1 464 819 | 10/2004 |
| WO | WO 2004/067948 | 8/2004 |
| WO | WO 2006/032577 | 3/2006 |

* cited by examiner

METHOD FOR CONTROLLING A FUEL INJECTION SYSTEM OF AN INTERNAL COMBUSTION ENGINE

This application is a National Stage Application of PCT/EP2008/062084, filed 11 Sep. 2008, which claims benefit of Serial No. 10 2007 050 297.6, filed 22 Oct. 2007 in Germany and which applications are incorporated herein by reference. To the extent appropriate, a claim of priority is made to each of the above disclosed applications.

TECHNICAL FIELD

The present invention relates to a method for controlling a fuel injection system of an internal combustion engine, wherein the fuel injection system comprises a manifold and a high-pressure pump, which is driven as a function of the engine rotational speed. A fuel dosing unit having an electromagnetically actuable control valve for delivering fuel is associated with the high-pressure pump, wherein the fuel dosing unit controls the amount of fuel delivered.

Such a fuel injection system is known from the German patent DE 198 53 103 A1. It comprises a high pressure pump, whose delivery rate can be adjusted by the amount of fuel entering into a delivery chamber of the high pressure pump being metered. For this purpose, a fuel dosing unit, which comprises an electromagnetically actuable control valve, is provided upstream of the delivery chamber. Depending on the position of a valve element of this electromagnetic control valve, an opening cross-section, through which the fuel must pass on its way to the delivery chamber, is more or less released. It can thereby be assumed that the delivery rate of the high-pressure pump is proportional to the opening cross-section.

It is furthermore known from the German patent DE 198 53 103 A1 that the opening cross-section can have a slot-shaped, circular or triangular geometry.

It is known from the German patent DE 10 2005 025 114 A1 that the delivery rate of the high-pressure pump, which is proportional to the opening cross-section of the control valve, is influenced by additional pump specific aspects. In addition, the fuel pressure at the inlet of the high-pressure pump and the vapor pressure of the fuel to be delivered have an influence on the delivery rate of the high-pressure pump.

SUMMARY

The aim of the present invention is therefore to provide a method and a device, which allow for an improved dosing of a fuel quantity, which is delivered to a high-pressure pump provided in a fuel injection system.

This problem is solved by a method for controlling a fuel injection system of an internal combustion engine. The fuel injection system comprises a manifold and a high-pressure pump. A fuel dosing unit is associated with the high-pressure pump. The fuel dosing unit controls the amount of fuel delivered. An amount of fuel required for the operation of the internal combustion engine is determined as a function of a correction factor, which is based on a fuel pressure at the inlet of the high-pressure pump and/or a vapor pressure of the fuel to be delivered.

The high-pressure pump is preferably driven as a function of the engine rotational speed, for example by a drive connected to the crankshaft. The fuel dosing unit preferably comprises an electromagnetically actuable control valve for delivering fuel.

The invention thus allows for the amount of fuel delivered to be influenced as a function of the fuel pressure at the inlet of the high-pressure pump and/or as a function of the vapor pressure of the fuel to be delivered in order to assure an improved dosing of the amount of fuel delivered to the high-pressure pump. In so doing, the control quality of the pressure control in the manifold can be improved according to the invention; and geometric and/or electrical tolerances of the high-pressure pump, respectively the fuel dosing unit, can be compensated.

The correction factor according to the invention is determined as the pressure difference between the fuel pressure at the inlet of the high pressure pump and the vapor pressure of the fuel to be delivered. The high-pressure pump preferably has a delivery chamber having a check valve disposed on the inlet side, an opening pressure of the check valve being ascertained for the determination of the correction factor. Said opening pressure is subtracted from the pressure difference to determine a pressure correction value.

The pressure difference effective at the control valve is therefore determined, which influences the amount of fuel delivered and is used to correct the amount of fuel which is delivered to the high-pressure pump. As a result of this, a precise pilot control of the high-pressure pump can be achieved by the fuel dosing unit; and in so doing, the influence of the type of fuel and of the corresponding pre-pressure is reduced and an improved diagnosis is made possible.

A desired fuel volume to be delivered to the high-pressure pump is preferably determined, the required amount of fuel being determined on the basis of the desired fuel volume and the correction factor. In this case, the correction factor can be determined with the aid of a characteristic curve, which defines suitable volume correction values for possible pressure correction values.

The use of a characteristic curve allows for a fast and simple determination of the correction factor.

According to the invention, an opening cross-section of the control valve, which is adjusted for delivering the required amount of fuel, is determined as a function of the correction factor. Using the opening cross-section of the control valve and a respective actual engine rotational speed, an activation signal is determined for the control valve. The activation signal is determined with the aid of a characteristic curve, which defines suitable activation signals as a function of possible opening cross-sections and actual engine rotational speeds.

The control valve is consequently activated as a function of the correction factor so that the fuel pressure at the inlet of the high-pressure pump and/or the vapor pressure of the fuel to be delivered when activating the control valve are taken into account, and an improved dosing of the amount of fuel delivered is assured. In so doing, the use of a characteristic curve allows for a fast and simple determination of the activation signal.

The vapor pressure is ascertained in one configuration of the invention from the actual temperature using at least one reference vapor pressure curve. The vapor pressure is alternatively ascertained from an afterstart and/or warmup factor and/or a factor of a transition compensation. It is furthermore possible for the pre-pressure used for ascertaining the vapor pressure to be reduced by an initial value until the delivery rate of the high-pressure pump is zero and the vapor pressure is ascertained from the difference of the pre-pressure and an opening pressure of a check valve of the high-pressure pump.

The problem mentioned at the beginning of the application is also solved by a computer program with a program code for carrying out all of the steps of a method according to the invention if the program is executed on a computer.

The problem mentioned at the beginning of the application is also solved by an internal combustion engine with a fuel injection system which comprises a manifold and a high-pressure pump. A fuel dosing unit is associated with the high-pressure pump. The fuel dosing unit controls the amount of fuel delivered. An amount of fuel required for the operation of the internal combustion engine can be determined as a function of a correction factor, which is based on a fuel pressure at the inlet of the high-pressure pump and/or on a vapor pressure of the fuel to be delivered.

An example of embodiment is explained below in detail with the aid of the accompanying drawing. The following are shown:

DETAILED DESCRIPTION

Figure 1:
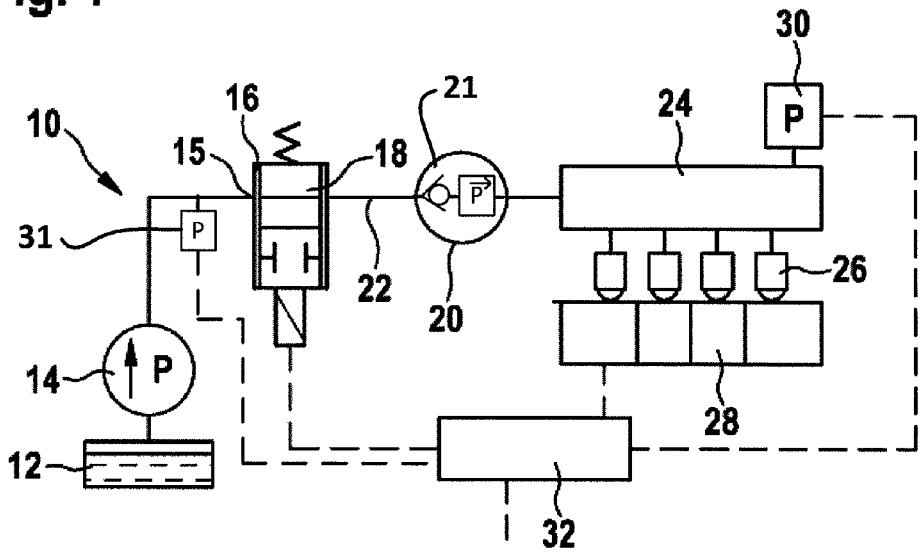
FIG. 1 is a schematic depiction of a fuel injection system of an internal combustion engine having a high-pressure pump and a fuel dosing unit.

FIG. 1 shows a schematic depiction of a fuel injection system 10 of an internal combustion engine. Said system comprises a fuel tank 12, from which a primer pump 14 delivers fuel to an inlet 15 of a fuel dosing unit 16. The outlet 18 of said unit leads to a fuel high-pressure pump 20. The low pressure line running from the fuel tank 12 up to the high pressure pump 20 bears in its entirety the reference numeral 22.

The high-pressure pump 20 preferably has a delivery chamber with a check valve disposed on its inlet side, compresses the fuel to a very high pressure and delivers it into a fuel collecting line 24, wherein the fuel is stored under high pressure and which is also referred to as the "manifold", respectively "rail". A plurality of injectors 26 is attached to said rail, which directly inject fuel into their associated combustion chambers 28 of the internal combustion engine, which is not depicted in further detail. The internal combustion engine serves, for example, to drive a motor vehicle.

The pressure in the fuel collecting line 24 is acquired by a pressure sensor 30. The pressure sensor 30 transmits its signals to a open- and closed-loop control device 32, which is connected on the outlet side to among other things the fuel dosing unit 16. By means of the fuel dosing unit 16, the delivery rate of the high pressure pump 20 is adjusted in a manner to be described later. The actual pressure in the fuel collecting line 24, which is acquired by the pressure sensor 30, can thereby be made to track a set-point pressure.

Figure 2:
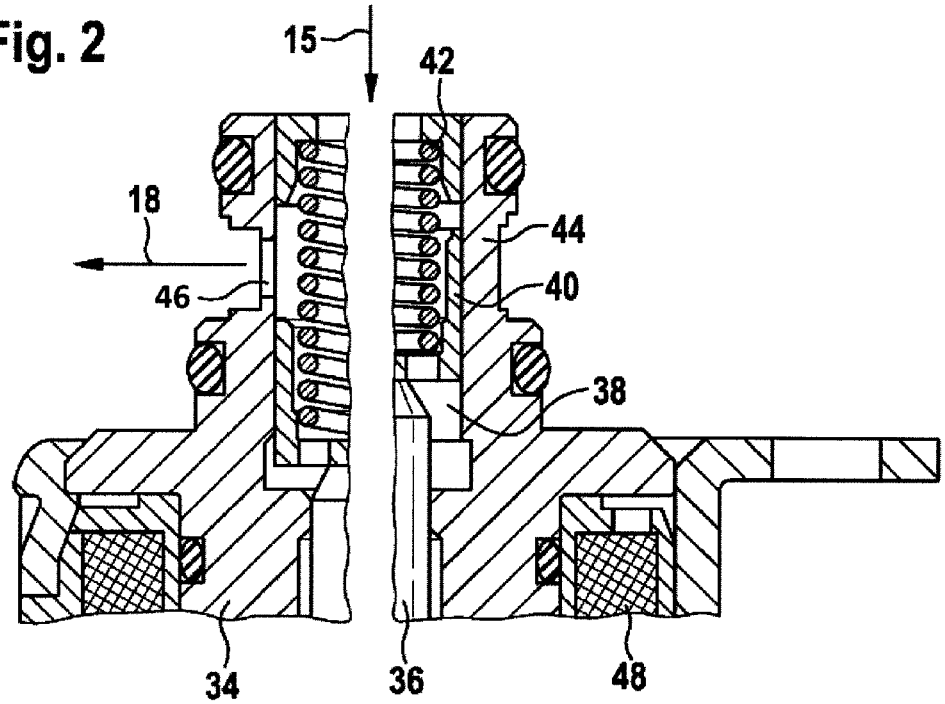
FIG. 2 is a partial sectional drawing through a region of the fuel dosing unit of FIG. 1 which is depicted in cut-away form.

As is apparent in FIG. 2, the fuel dosing unit 16 is configured as an intake throttle. It comprises a housing 34, wherein a valve piston 36 is accommodated in an axially displaceable manner. The valve piston 36 protrudes into a valve chamber, wherein a slide valve 40 is accommodated in an axially displaceable manner. The slide valve 40 is pressed against the valve piston 36 by a compression spring 42. The inlet 15 of the fuel dosing unit 16 is configured on the axial end of the valve chamber 38, whereas the outlet 18 is configured in the form of a control opening 46 in a radial wall 44 of the valve chamber 38.

The position of the valve piston 36 is adjusted by an electromagnetic actuator 48. When no current is present, the valve spring 42 presses the slide valve 40 and the valve piston 36 completely downward in FIG. 2. This power-off state is depicted in the left half of FIG. 2. If on the other hand current is supplied to the actuator 48, the valve piston 36 presses the slide valve 40 upward against the force of the valve spring 42 in FIG. 2 so that said slide valve 40 partially or in the end position completely covers the control opening 46 in the radial wall 44. This power-on state is shown in the right half of FIG. 2. If the control opening 46 is completely free, a maximum amount of fuel travels from the primer pump 14 to the high-pressure pump 20 and from there further into the rail 24. This operating state is referred to as full delivery. If on the other hand the control opening 46 is partially covered by the slide valve 40, a smaller amount of fuel travels to the high pressure pump 20 and into the rail 24. This operating state is referred to as "partial delivery".

A method for controlling the fuel injection system 10 of FIG. 1 according to an embodiment of the invention is described below in detail and with reference to FIG. 3.

Figure 3:
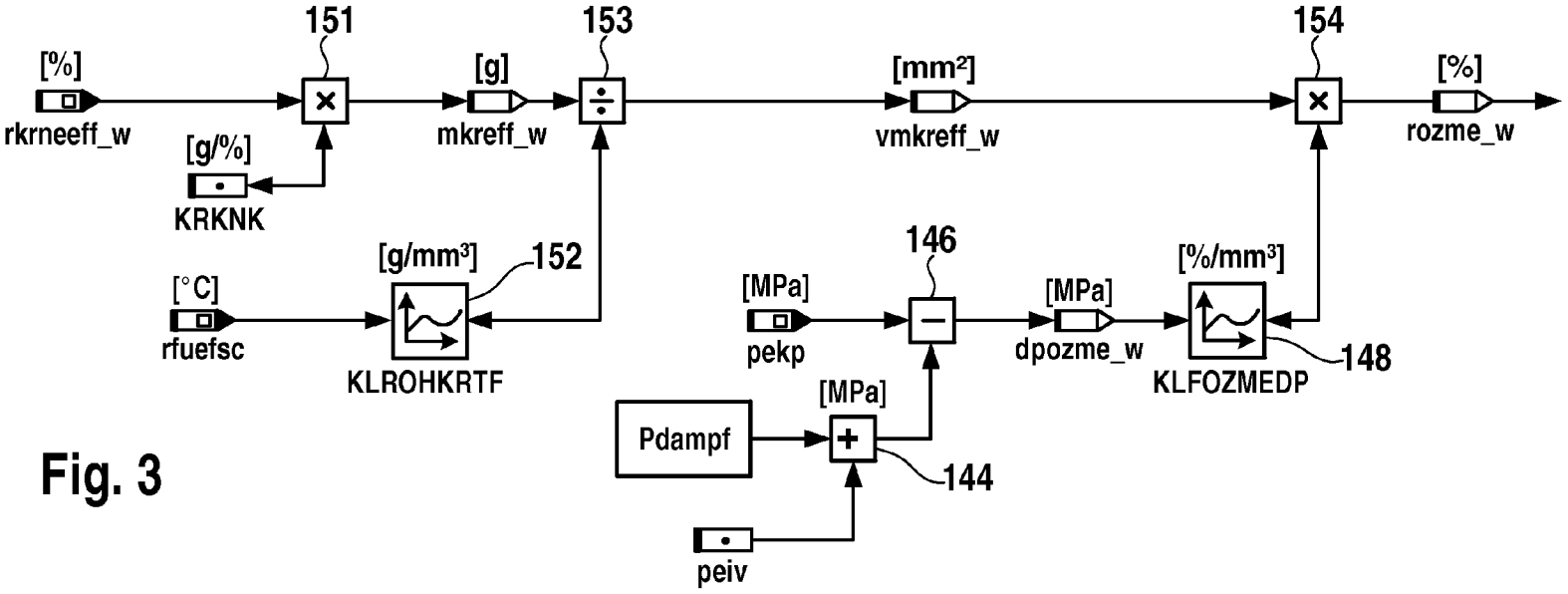
FIG. 3 is a schematic depiction of a method for determining an opening cross-section for a control valve of the fuel dosing unit of FIG. 1.

FIG. 3 shows a schematic depiction of a method for determining an opening cross-section rozme_w for the electromagnetically actuable control valve of the fuel dosing unit 16 of FIGS. 1 and 2, said control valve being formed from the valve piston 36, the electromagnetic actuator 48, the valve spring 42 and the slide valve 40. According to a preferred embodiment of the invention, the method is implemented as a computer program and is executed by the open- and closed-loop control device 32. The invention can therefore be simply and cost effectively implemented with components already present in the internal combustion engine.

In the following description of the method according to the invention, a detailed explanation of the procedural steps known in the technical field is foregone.

In step 151, a fuel mass mkreff_w injected from the high-pressure pump 20 into the manifold 24 is calculated. This is converted in step 153 as a function of a temperature dependent fuel density KLROHKRTF into a set-point fuel volume vmkreff_w to be delivered to the high-pressure pump 20. The temperature dependent fuel density KLROHKRTF can be ascertained according to the invention in step 152 with the aid of a suitable characteristic curve which is based on a measured fuel temperature.

In step 154, a required amount of fuel for operating the internal combustion engine is determined from the set-point fuel volume to be delivered vmkreff_w and a correction factor KLFOZMEDP. This required amount of fuel must be delivered to the high pressure pump 20 and from this to the manifold 24 in order to assure a fuel pressure and fuel rate there, which is necessary for the respective operating state of the internal combustion engine.

The opening cross-section rozme_w of the control valve is determined according to the invention in step 154. This is to be adjusted to feed the required amount of fuel to the high-pressure pump 20. As is described below with regard to FIG. 4, a suitable activation signal for the control valve is determined on the basis of the ascertained opening cross-section rozme_w.

The correction factor KLFOZMEDP can be ascertained in step 148 with the aid of a family of characteristics. Said family describes volume correction values as a function of possible pressure correction values, which are suited as a correction factor KLFOZMEDP for determining the required amount of fuel.

The method according to the invention is preferably executed in the form of a loop by the open loop- and closed-loop 32 control device 32. The correction factor KLFOZMEDP in step 148 is accordingly determined in each case for an actual pressure correction value dpzme_w, which is determined in step 146 by subtracting the vapor pressure Pdampf of the fuel to be delivered as well as the opening pressure peiv of the check valve from the fuel pressure pekp at the inlet of the high-pressure pump 20. In this connection, the vapor pressure Pdampf of the fuel to be delivered and the opening pressure peiv of the check valve can be previously added up in step 144.

A pressure difference between the fuel pressure pekp at the inlet of the high-pressure pump 20 and the vapor pressure Pdampf of the fuel to be delivered can also alternatively be initially determined. In this case, the opening pressure peiv of the check valve can be subtracted from to ascertained pressure difference to determine the pressure correction value.

According to an additional embodiment of the invention, the actual pressure correction value dpzme_w can also be ascertained with the aid of an empirically ascertained correlation, as, for example, using a family of characteristics. A suitable family of characteristics can be ascertained as a function of vapor pressure Pdampf and fuel pressure pekp for low pressure systems with a variable fuel pressure or only as a function of vapor pressure Pdampf, for example for low pressure systems with a constant fuel pressure.

The vapor pressure Pdampf can be determined in different ways. This is substantially dependent on the temperature and is only limitedly dependent on the fuel used. The vapor pressure can accordingly be ascertained in the simplest case as a function of a respective actual temperature from a suitable, so-called reference vapor pressure curve. In order to take into account here the dependencies of the vapor pressure Pdampf on the fuel used, a plurality of reference vapor curves can be used depending on the fuel system, in particular in the case of "flex fuel systems", wherein a corresponding curve is associated with each possible fuel.

The vapor pressure Pdampf can furthermore be determined using the adapted afterstart, respectively warmup, factor or using the adapted factor of the transition compensation. These directly correlate with the vapor pressure Pdampf of the fuel used because they represent a measurement for the evaporation loss of the fuel.

A further possibility for determining the vapor pressure Pdampf consists of decreasing the pre-pressure Pvoradap up until the delivery of the high-pressure pump 20 breaks down. The adjusted pressure then corresponds to the vapor pressure Pdampf, which has been increased by the opening pressure peiv of the check valve in the high-pressure pump 20 and which consequently results at Pdampf=Pvoradap−peiv. The opening pressure peiv can be considered constant as a close approximation.

Furthermore, the vapor pressure Pdampf can be determined as a result of a value being determined within the scope of the fuel tank ventilation, which serves as a measurement for the depletion of the associated active charcoal filter, a high value indicating a very volatile fuel. From this value, the vapor pressure Pdampf can be ascertained while taking into account a respective actual temperature.

The pre-pressure pekp can be measured according to the invention with a suitable sensor or modeled with the aid of activation parameters of the electric fuel pump 14. Thus in the case of a constant pressure system with a mechanical pressure regulator, its adjusted opening pressure can be used while taking into account the drop in pressure across the fuel line 22.

Figure 4:
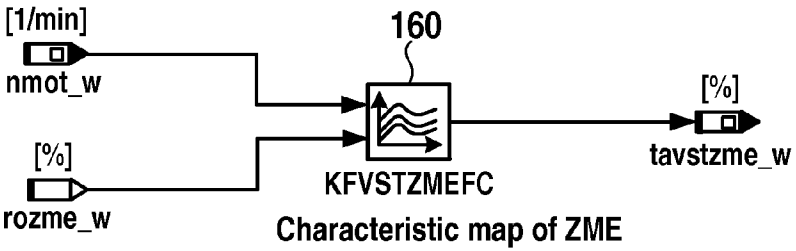
FIG. 4 is a schematic depiction of a method for determining an activation signal for a control valve of the fuel dosing unit of FIG. 1.

FIG. 4 shows a schematic depiction of a method for determining an activation signal for the control valve of the fuel dosing unit 16 of FIGS. 1 and 2. According to a preferred embodiment of the invention, this method is likewise implemented as a computer program and is executed by the open- and closed-loop control device 32.

In step 160 a suitable activation signal tavstzme_w is determined for the control valve on the basis of the opening cross-section rozme_w ascertained according to FIG. 3 and a respective actual engine rotational speed nmot_w. Said signal tavstzme_w is preferably determined with the aid of a family of characteristics, which has different characteristic curves for different possible actual engine rotational speeds nmot_v, each characteristic curve defining suitable activation signals tavstzme_w as a function of possible opening cross-sections rozme_w.

The invention claimed is:

1. A method for controlling a fuel injection system of an internal combustion engine, wherein the fuel injection system comprises a manifold and a high-pressure pump and a fuel dosing unit is associated with the high-pressure pump, comprising:

controlling the amount of fuel delivered, wherein controlling the amount of fuel delivered is performed by the fuel dosing unit;

determining an amount of fuel required for the operation of the internal combustion engine as a function of a correction factor, wherein the correction factor is based on a fuel pressure at the inlet of the high-pressure pump and on a vapor pressure of the fuel to be delivered;

ascertaining a pressure difference between the fuel pressure at the inlet of the high-pressure pump and the vapor pressure of the fuel to be delivered for determining the correction factor, wherein the high-pressure pump has a delivery chamber with a check valve disposed at the inlet side of said chamber;

ascertaining an opening pressure of the check valve for determining the correction factor; and subtracting the opening pressure of the check valve from the pressure difference to determine a pressure correction value.

2. The method according to claim 1, further comprising:

determining a set-point fuel volume to be delivered to the high-pressure pump, wherein the required amount of fuel is determined on the basis of the set-point fuel volume and the correction factor.

3. The method according to claim 2, wherein the correction factor is determined with the aid of a characteristic curve, which defines volume correction values for possible pressure correction values.

4. The method according to claim 1, further comprising:

determining an opening cross-section of the control valve, which is adjusted for the delivery of the required amount of fuel, as a function of the correction factor.

5. The method according to claim 4, further comprising:

determining an activation signal for the control valve using the opening cross-section of the control valve and a respective actual engine rotational speed.

6. The method according to claim 5, wherein the activation signal is determined with the aid of a characteristic curve, which defines suitable activation signals as a function of possible opening cross-sections and engine rotational speeds.

7. The method according to claim 1, wherein the vapor pressure is ascertained from the actual temperature using at least one reference vapor pressure curve.

8. The method according to claim 1, wherein the vapor pressure is ascertained from an afterstart, a warmup factor, or a factor of a transition compensation.

9. The method according to claim 1, wherein the pre-pressure is decreased from an initial value until the delivery rate of the high pressure pump is zero and the vapor pressure is ascertained from the difference of the pre-pressure and an opening pressure of a check valve of the high-pressure pump.

10. A computer program with program code for carrying out all of the steps according to claim 1, if the program is executed on a computer.

11. An internal combustion engine with a fuel injection system, comprising:

a manifold and a high-pressure pump, wherein a fuel dosing unit is associated with the high-pressure pump and the fuel dosing unit controls the amount of fuel delivered;

wherein an amount of fuel required for the operation of the internal combustion engine can be determined as a function of a correction factor, which is based on a fuel pressure at the inlet of the high-pressure pump and on a vapor pressure of the fuel to be delivered;

wherein a pressure difference between the fuel pressure at the inlet of the high-pressure pump and the vapor pressure of the fuel to be delivered is ascertained for determining the correction factor;

wherein the high-pressure pump has a delivery chamber with a check valve disposed at the inlet side of said chamber; and wherein an opening pressure of the check valve is ascertained for determining the correction factor and is subtracted from the pressure difference for determining a pressure correction value.

* * * * *